US005855359A

United States Patent [19]

Chipperfield

[11] Patent Number: 5,855,359

[45] Date of Patent: Jan. 5, 1999

[54] COMBINATION WHEEL RAMP AND JACK

[76] Inventor: Gerald N Chipperfield, 1473 Dunwoodie Ct., Florence, Ky. 41042

[21] Appl. No.: 821,214

[22] Filed: Mar. 20, 1997

[51] Int. Cl.[6] ..... E02C 3/00

[52] U.S. Cl. ..... 254/88; 254/122; 254/126

[58] Field of Search ..... 254/122, 126, 254/9 R, 9 B, 9 C, 88; 14/69.5, 71.3

[56] References Cited

U.S. PATENT DOCUMENTS

| | | | |
|---|---|---|---|
| 1,527,901 | 2/1925 | Munday | 254/88 |
| 3,863,895 | 2/1975 | Grewe et al. | 254/88 |
| 4,025,053 | 5/1977 | Stickle | 254/122 |
| 4,534,544 | 8/1985 | Heide | 254/9 C |
| 4,901,980 | 2/1990 | Hansen | 254/88 |
| 5,503,368 | 4/1996 | Torres | 254/88 |

*Primary Examiner*—Robert C. Watson

[57] ABSTRACT

A new combination wheel ramp and jack for raising a wheel and a corresponding part of the vehicle so that access to the underside of the vehicle is more easily achieved. The inventive device includes a lower support base assembly, an upper wheel platform assembly, a scissors assembly connecting the support base assembly and the wheel platform assembly and causing vertical movements of the wheel platform assembly when actuated, and a screwjack assembly connected to the scissors assembly for actuating the scissors assembly and thus causing vertical movement of the wheel platform assembly.

13 Claims, 4 Drawing Sheets

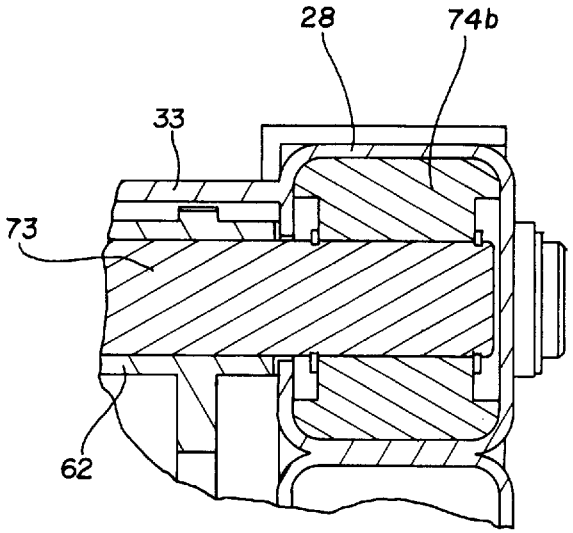
FIG. 4
FIG. 5
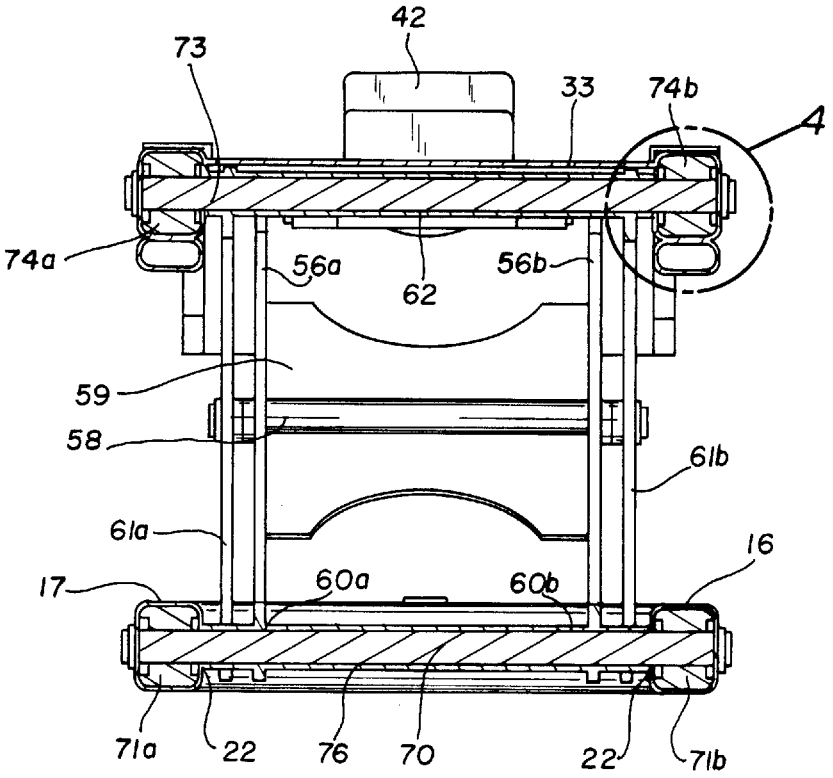

COMBINATION WHEEL RAMP AND JACK

BACKGROUND OF THE INVENTION

1. Field of the Invention

The present invention relates to wheel ramps and more particularly pertains to a new combination wheel ramp and jack for raising a wheel and a corresponding part of the vehicle so that access to the underside of the vehicle is more easily achieved.

2. Description of the Prior Art

The use of wheel ramps is known in the prior art. More specifically, wheel ramps heretofore devised and utilized are known to consist basically of familiar, expected and obvious structural configurations, notwithstanding the myriad of designs encompassed by the crowded prior art which have been developed for the fulfillment of countless objectives and requirements.

A known prior art wheel ramp is disclosed in U.S. Pat. No. 5,447,406. However, many modern cars have low air dams on their front and rear ends which prevent these cars from being driven up many conventional wheel ramps. Additionally, driving a vehicle up conventional wheel ramps can be a hazardous operation, due to the height of the ramps, which results in many heavy vehicles causing the ramps to shed away before the wheels are properly located on the ramps, due to the large slope of the ramps.

In addition, U.S. Pat. No. 4,901,980, U.S. Pat. No. 5,340,082, U.S. Pat. No. 5,156,238, U.S. Pat. No. 5,297,653 and U.S. Pat. No. Des. 349,802 all teach devices which can be used to lift an entire vehicle off of the ground, permitting access to the underside of the vehicle. However, these devices are expensive, require a large amount of space, and are complicated to use. Such devices are therefore not practical for many do-it-yourself mechanics.

While these devices fulfill their respective, particular objectives and requirements, the aforementioned patents do not disclose a new combination wheel ramp and jack. The inventive device includes a lower support base assembly, an upper wheel platform assembly, a scissors assembly connecting the support base assembly and the wheel platform assembly and causing vertical movements of the wheel platform assembly when actuated, and a screwjack assembly connected to the scissors assembly for actuating the scissors assembly and thus causing vertical movement of the wheel platform assembly.

In these respects, the combination wheel ramp and jack according to the present invention substantially departs from the conventional concepts and designs of the prior art, and in so doing provides an apparatus primarily developed for the purpose of raising a wheel and a corresponding part of the vehicle so that access to the underside of the vehicle is more easily achieved.

SUMMARY OF THE INVENTION

In view of the foregoing disadvantages inherent in the known types of wheel ramps now present in the prior art, the present invention provides a new combination wheel ramp and jack construction wherein the same can be utilized for raising a wheel and a corresponding part of the vehicle so that access to the underside of the vehicle is more easily achieved.

The general purpose of the present invention, which will be described subsequently in greater detail, is to provide a new combination wheel ramp and jack apparatus and method which has many of the advantages of the wheel ramps mentioned heretofore and many novel features that result in a new combination wheel ramp and jack which is not anticipated, rendered obvious, suggested, or even implied by any of the prior art wheel ramps, either alone or in any combination thereof.

To attain this, the present invention generally comprises a lower support base assembly, an upper wheel platform assembly, a scissors assembly connecting the support base assembly and the wheel platform assembly and causing vertical movements of the wheel platform assembly when actuated, and a screwjack assembly connected to the scissors assembly for actuating the scissors assembly and thus causing vertical movement of the wheel platform assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new combination wheel ramp and jack apparatus and method which has many of the advantages of the wheel ramps mentioned heretofore and many novel features that result in a new combination wheel ramp and jack which is not anticipated, rendered obvious, suggested, or even implied by any of the prior art wheel ramps, either alone or in any combination thereof.

It is another object of the present invention to provide a new combination wheel ramp and jack which may be easily and efficiently manufactured and marketed.

It is a further object of the present invention to provide a new combination wheel ramp and jack which is of a durable and reliable construction.

An even further object of the present invention is to provide a new combination wheel ramp and jack which is susceptible of a low cost of manufacture with regard to both materials and labor, and which accordingly is then susceptible of low prices of sale to the consuming public, thereby making such combination wheel ramp and jack economically available to the buying public.

Still yet another object of the present invention is to provide a new combination wheel ramp and jack which provides in the apparatuses and methods of the prior art some of the advantages thereof, while simultaneously overcoming some of the disadvantages normally associated therewith.

Still another object of the present invention is to provide a new combination wheel ramp and jack for raising a wheel and a corresponding part of the vehicle so that access to the underside of the vehicle is more easily achieved.

Yet another object of the present invention is to provide a new combination wheel ramp and jack which includes a lower support base assembly, an upper wheel platform assembly, a scissors assembly connecting the support base assembly and the wheel platform assembly and causing vertical movements of the wheel platform assembly when actuated, and a screwjack assembly connected to the scissors assembly for actuating the scissors assembly and thus causing vertical movement of the wheel platform assembly.

Still yet another object of the present invention is to provide a new combination wheel ramp and jack that requires less storage space than conventional wheel ramps.

Even still another object of the present invention is to provide a new combination wheel ramp and jack that is safer than conventional wheel ramps since the initial height of the combination wheel ramp and jack is lower than conventional ramps.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 4 is a close up view of the portion contained within the circled line 4—4 of FIG. 5.

FIG. 5 is a cross sectional view taken along line 5—5 of FIG. 2.

DESCRIPTION OF THE PREFERRED EMBODIMENT

Figure 1:
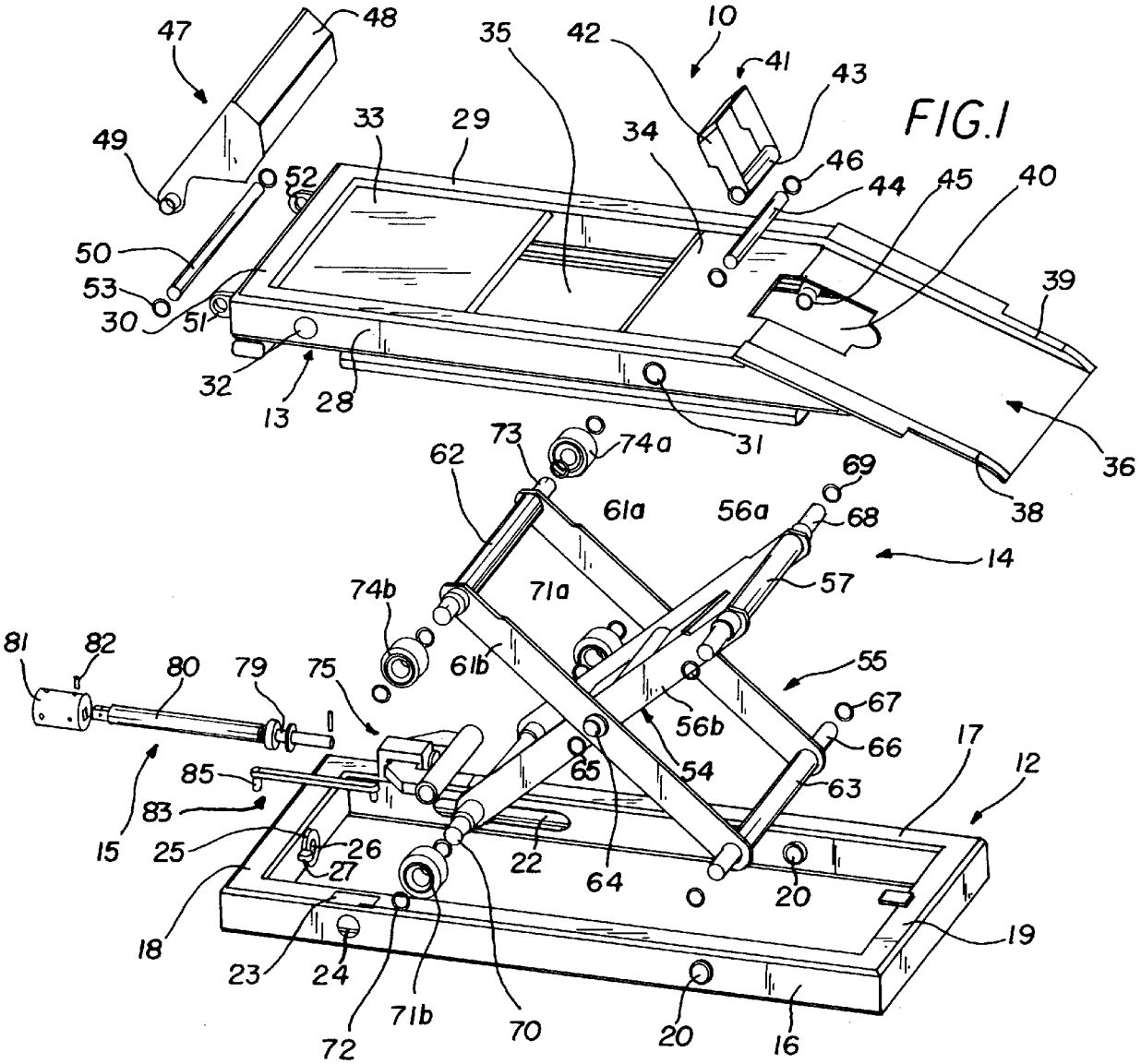
FIG. 1 is an exploded view showing all the elements of the present invention.

With reference now to the drawings, and in particular to FIGS. 1 through 7 thereof, a new combination wheel ramp and jack embodying the principles and concepts of the present invention and generally designated by the reference numeral 10 will be described.

As best illustrated in FIGS. 1 through 7, the combination wheel ramp and jack 10 includes a lower support base assembly 12, an upper wheel platform assembly 13, a scissors assembly 14 connected between the support base assembly 12 and the platform assembly 13, and an actuation means 15.

The lower support base assembly 12 comprises a rectangular frame composed of tubular side rails 16,17 and tubular end rails 18,19, with the rails 16–19 being secured together by welding. The side rails 16,17 each include a pivot housing 20 extending therethrough and welded in place, intermediate their ends. The side rails 16,17 each further include an elongated slot 22 formed through the interior walls thereof leading to the hollow interior of the rails, a hole 23 formed through the top walls, and a retaining ring hole 24 formed through the exterior wall opposite the slot 22.

The end rail 18 includes a boss 25 therein which defines a threaded passage 26 through which extends the actuation means 15. A tab 27 is formed on the boss and includes a hole (not shown) extending therethrough for permitting attachment of a latch means to be later described.

The wheel platform assembly 13 includes a pair of tubular side rails 28,29 and a tubular end rail 30 secured together by welding. The side rails 28,29 are similar to the rails 16,17, in that they each include a pivot housing 31 extending therethrough and secured in place by welding, vertically corresponding in location to the housings 20, an elongated slot (not shown), a hole similar to the hole 23 but formed through the bottom wall of the side rail, and a retaining ring hole 32 opposite the elongated slot.

Figure 2:
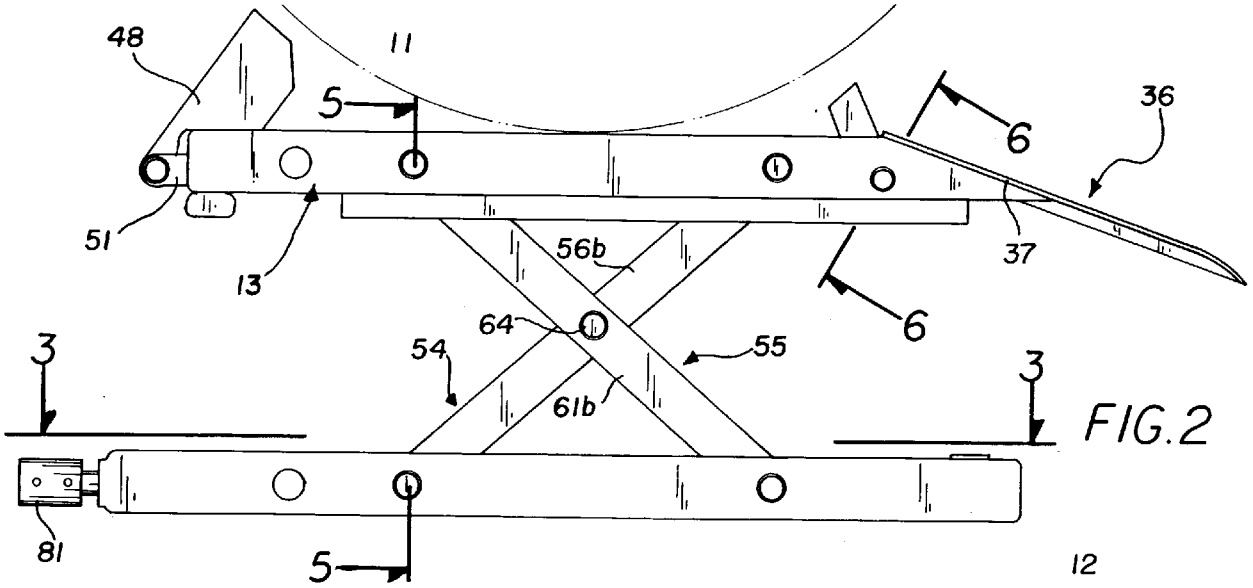
FIG. 2 is a side view of the present invention.

Two wheel deck plates 33,34 are secured between the side rails 28,29 and the end rail 30, such as by being welded thereto. The deck plates 33,34 are spaced so as to define a wheel stop space 35 therebetween. As illustrated in FIG. 2, when a wheel 11 (partially shown in broken lines) is supported by the assembly 13, the wheel rests partially within the space 35, so as to prevent movement of the wheel. An angled tire entry ramp 36 is fixedly attached to the front of the side rails 28,29 by being welded to an angled surface 37 of each side rail. The ramp 36 includes a pair of raised guide rails 38,39 for preventing the wheel from sliding off the sides of the ramp 36. The ramp 36 also includes a cut-out 40 therein permitting pivoting movements of a rear wheel stop 41.

The rear wheel stop 41 is a U-shaped member 42 secured to a tubular member 43, and pivotally attached to the side rails 28,29 by a pivot shaft 44 extending through the member 43 and into bosses 45 extending from the side rails 28,29. The pivot shaft is secured in place by retaining rings 46 at each end thereof. The stop 41 is sized so that it is able to pivot between an extended position (shown in FIG. 2) where it is located directly behind the wheel 11 to prevent rearward movement of the wheel, and a retracted position (shown in FIG. 7) where it is disposed through the cut-out 40 so as to allow the wheel 11 free movement up or down the ramp 36.

A front wheel stop 47 is also pivotally secured to the end rail 30. The front wheel stop 47 comprises a U-shaped member 48 having a boss 49 on each leg thereof, through which extends a pivot shaft 50. The shaft 50 is retained by a pair of ears 51,52 extending from the end rail 30, and fixed by a retaining ring 53 at each end. The stop 47 is thus adapted to pivot between an extended position (shown in FIG. 3) in front of the wheel 11 in order to prevent forward movement of the wheel, and a retracted position (FIG. 7) to minimize the vertical height of the apparatus 10.

The scissors assembly 14 comprises a primary scissor arm 54 and a secondary scissor arm 55. The arm 54 includes a pair of parallel side plates 56*a,b* having a tubular pivot housing 57 affixed to the plates at one end, a central, tubular pivot housing 58 affixed to the plates at the middle thereof, a stiffening web 59 centrally affixed to the side plates in order to provide stiffening, and bosses 60*a,b* on each side plate at the opposite end. The arm 55 includes a pair of parallel side plates 61*a,b* with tubular pivot housings 62,63 secured between the plates at each end.

The two arms 54,55 are pivotally connected at their middles by a center pivot shaft 64 extending through the side plates 56*a,b* and 61*a,b* and through the tubular pivot housing 58, with a retaining ring 65 on each end of the shaft 64 to secure it in place. A pivot shaft 66 extends through the tubular housing 63 and into each pivot housing 20 for pivotally securing that end of the arm 55 to the support base assembly 12. The shaft 66 is secured in place by a retaining ring 67 at each end located outside of the pivot housing 20. A pivot shaft 68 extends through the tubular housing 57 and into the pivot housings 31 in the side rails of the assembly 13, similar to the shaft 66, and secured in place by retaining rings 69 located outside of the pivot housings 31.

The opposite end of the arm 54 includes a roller shaft 70 extending through the bosses 60*a,b* and through the slots 22, with rollers 71*a,b* being attached to each end of the shaft 70. The rollers 71*a,b* are disposed within the hollow interior of the side rails 16,17 for sliding movement therein. Access to the rollers is provided by the holes 23, and access to retaining rings 72 which secure the rollers to the shaft is provided by the holes 24. The opposite end of the arm 55 is similarly secured to the wheel platform assembly 13, using a roller shaft 73 and rollers 74*a,b*.

Figure 3:
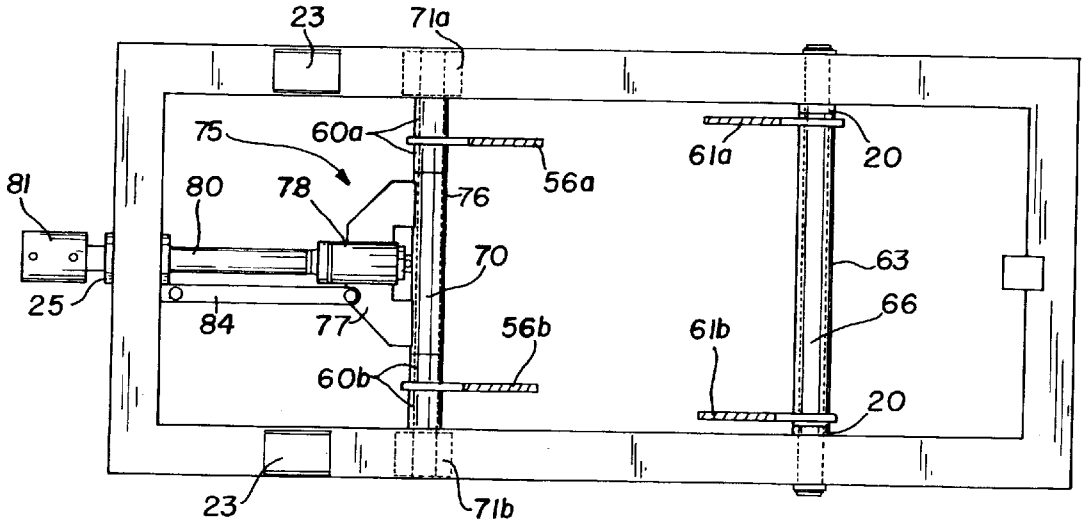
FIG. 3 is a cross sectional view taken along line 3—3 of FIG. 2.
Figure 6:
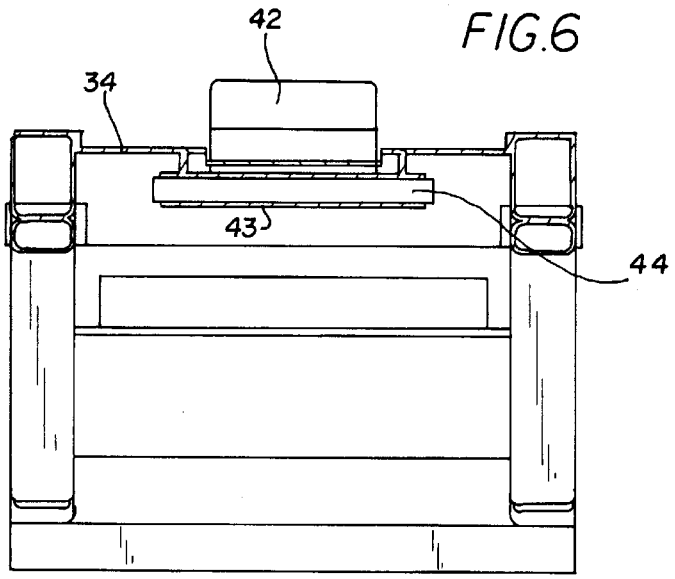
FIG. 6 is a cross sectional view taken along line 6—6 of FIG. 2.

As best shown in FIGS. 1 and 3, a pusher bracket 75 is secured to the scissors assembly 14. The bracket 75 includes a tubular housing 76 disposed around the roller shaft 70 between the bosses 60*a,b*, and a bracket 77 secured at each of its ends to the housing 76. A boss portion 78 is attached to the bracket 77, and has a hole therein through which one end of a rod 79 is rotationally received. The rod 79 forms a portion of the actuation means 15, along with exterior threaded portion 80. The rod 79 includes a large integral shoulder to support a thrust washer which locates against the boss portion 78. The end of rod 79 protrudes through the other side of the boss portion and receives a washer which is held in place by a dowel extending through the rod. The threaded portion 80 of the actuation means engages with the threaded passage 26 of the boss 25, thus forming a screwjack mechanism. The threaded portion 80 extends through the aperture 26 in the boss 25 to the exterior of the support base 12, where the end of the sleeve is attached to a ratchet adapter 81 by set screws 82. Thus it is seen that by rotating the adapter 81, the engagement between the threads of the portion 80 and the passage 26 will cause the actuation means 15 to extend or retract, thus raising or lowering the scissors assembly. The adapter includes a square recess (not shown) in the end surface thereof which is adapted to receive a protruding square head of a drive ratchet. Thus the actuation mechanism is able to be rotated using a common ratchet device.

Safety latch means 83 is provided in order to lock the pusher bracket 75 and scissors assembly in place, so as to prevent vertical movement of the wheel platform assembly. The latch means 83 comprises a bar 84 having a pin 85 at each end thereof. One end of the bar is selectively secured to the end rail 18 by inserting the pin 85 through the hole provided in the tab 27, while the opposite end of the bar is selectively secured to the bracket 77 by disposing the pin 85 through a hole (not shown) provided in the bracket 77.

Figure 7:
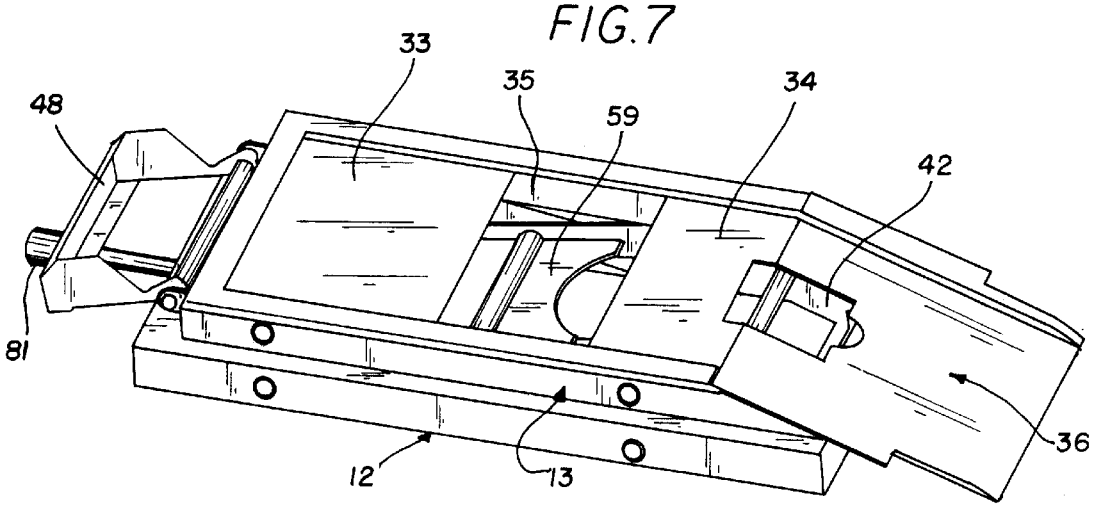
FIG. 7 is a perspective view of the combination wheel ramp and jack in a lowered position.

In use, with the apparatus in a lowered position as shown in FIG. 7, the vehicle is driven up the angled ramp until the wheel locates within the stop space 35. The height of the ramp in the lowered position is typically on the order of 4.5 inches, so the wheel only has to travel a short distance vertically before it is located on the wheel deck. Thus the apparatus 10 easily fits under modern vehicles having low air dams, permitting the wheels of such vehicles to be driven onto the wheel platform assembly. Once the wheel is located within the stop space, the stops 41,47 are pivoted to their extended positions to aid in preventing wheel movements. A ratchet or other similar tool is then engaged with either the end of the threaded portion 80 or the adapter 81 so as to rotate the threaded portion 80 and thus cause the threaded portion to extend from the boss 25. The rod 79 pushes on the pusher bracket, which in turn pushes the end of the primary scissor arm. This causes the scissor assembly to pivot upward, resulting in raising of the wheel platform assembly. Thus the wheel and the associated portions of the vehicle are lifted off the ground, providing access to the underside of the vehicle. The wheel platform assembly is typically raised to a height of about 1 foot, so that the total vertical movement of the assembly 13 is about 7.5 inches. Once in the raised position (FIG. 2), the bar 84 is secured in place so as to lock the elements in place so that the assembly 13 cannot unintentionally lower itself.

Although the invention has been shown and described in relation to a single wheel, it should be realized that the apparatus 10 could be used for each wheel in order to raise the whole vehicle, both the front wheels to raise the entire front end of the vehicle, or the rear wheels to raise the entire rear end of the vehicle. The apparatus could also be modified for use as a transmission jack, or for use under the suspension of a vehicle for removal of the wheels. Wheels could also be removably attached to the support base assembly, permitting easy transport of the apparatus 10.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A wheel ramp for lifting a single wheel of a wheeled vehicle, comprising:

a lower support base assembly;

an upper wheel platform assembly adapted for supporting the single wheel thereon;

scissor assembly means operatively connected to the lower support base assembly and to the upper wheel platform assembly for causing vertical movements of the wheel platform assembly relative to the support base assembly;

actuation means operatively connected to the scissor assembly means for actuating the scissor assembly means, which results in vertical movement of the wheel platform assembly;

wherein the wheel platform assembly comprises a frame, a wheel deck connected to the frame and having opposite ends and a longitudinal axis extending between said opposite ends, and an angled tire entry ramp extending from one end of the wheel deck and being fixedly connected to the frame: and wherein the wheel deck comprises two substantially horizontal deck portions, each of said deck portions being positioned at an end of said wheel platform, said deck portions being longitudinally spaced from each other with a single gap therebetween forming a wheel stop space such that a wheel rolled onto said wheel platform bridges between said deck portions with a portion of said wheel depending into said wheel stop space to provide an indication to a driver of said vehicle that said wheel is substantially centered on said wheel platform while seated in said vehicle.

2. The wheel ramp of claim 1, wherein said scissor assembly means comprises a primary scissor arm and a secondary scissor arm pivotally connected to each other.

3. The wheel ramp of claim 2, wherein said primary scissor arm includes a pair of first rollers at one end thereof, and said support base assembly includes a pair of side rails which slidingly support the pair of first rollers therein.

4. The wheel ramp of claim 3, wherein the secondary scissor arm includes a pair of second rollers at one end thereof, and said wheel platform assembly includes a pair of side rails which slidingly support the pair of second rollers therein.

5. The wheel ramp of claim 2, wherein said actuation means is connected to a first end of the primary scissor arm.

6. The wheel ramp of claim 1, wherein said actuation means comprises a screwjack mechanism attached to the support base assembly.

7. The wheel ramp of claim 6, wherein said screwjack mechanism includes an adapter attached thereto, said adapter including means thereon which facilitate turning movements of the adapter by a ratchet device.

8. The wheel ramp of claim 6, wherein the screwjack mechanism comprises a threaded rod which is received within a threaded boss mounted within the lower support base assembly.

9. The wheel ramp of claim 1, further comprising a safety latch means for preventing vertical movement of the wheel platform assembly.

10. The wheel ramp of claim 9, wherein the safety latch means comprises a bar extending between the support base assembly and the scissor assembly means.

11. The wheel ramp of claim 1, wherein the wheel platform assembly further includes pivoting stop means thereon for stopping the single wheel in position.

12. The wheel ramp of claim 11, wherein the pivoting stop means comprises a front wheel stop pivotally connected to the wheel platform assembly for stopping the front of the single wheel, and a rear wheel stop pivotally connected to the wheel platform assembly for stopping the rear of the single wheel.

13. A wheel ramp for lifting a single wheel of a wheeled vehicle, comprising:

a lower support base assembly;

an upper wheel platform assembly adapted for supporting the single wheel thereon;

scissor assembly means operatively connected to the lower support base assembly and to the upper wheel platform assembly for causing vertical movements of the wheel platform assembly relative to the support base assembly;

actuation means operatively connected to the scissor assembly means for actuating the scissor assembly means, which results in vertical movement of the wheel platform assembly;

wherein said scissor assembly means comprises a primary scissor arm and a secondary scissor arm pivotally connected to each other;

wherein said primary scissor arm includes a pair of first rollers at one end thereof, and said support base assembly includes a pair of side rails which slidingly support the pair of first rollers therein;

wherein the secondary scissor arm includes a pair of second rollers at one end thereof, and said wheel platform assembly includes a pair of side rails which slidingly support the pair of second rollers therein;

wherein said actuation means is connected to a first end of the primary scissor arm;

wherein said actuation means comprises a screwjack mechanism attached to the support base assembly;

wherein said screwjack mechanism includes an adapter attached thereto, said adapter including means thereon which facilitate turning movements of the adapter by a ratchet device;

wherein the screwjack mechanism comprises a threaded rod which is received within a threaded boss mounted within the lower support base assembly;

a safety latch means for preventing vertical movement of the wheel platform assembly;

wherein the safety latch means comprises a bar extending between the support base assembly and the scissor assembly means;

wherein the wheel platform assembly comprises a frame, a wheel deck connected to the frame, and an angled tire entry ramp extending from the wheel deck and fixedly connected to the frame;

wherein the wheel deck comprises two spaced deck portions forming a wheel stop space therebetween, the wheel stop space adapted to support the single wheel therein when the single wheel is supported by the wheel platform assembly;

wherein the wheel platform assembly further includes pivoting stop means thereon for stopping the single wheel in position; and wherein the pivoting stop means comprises a front wheel stop pivotally connected to the wheel platform assembly for stopping the front of the single wheel, and a rear wheel stop pivotally connected to the wheel platform assembly for stopping the rear of the single wheel.

* * * * *